US007914200B1

(12) United States Patent
Hockmeyer et al.

(10) Patent No.: US 7,914,200 B1
(45) Date of Patent: Mar. 29, 2011

(54) MIXING BLADE ASSEMBLY WITH TRAILING SCRAPERS AND METHOD

(76) Inventors: Herman H. Hockmeyer, Saddle River, NJ (US); Matthew S. O'Kelley, Edenton, NC (US)

( * ) Notice: Subject to any disclaimer, the term of this patent is extended or adjusted under 35 U.S.C. 154(b) by 0 days.

(21) Appl. No.: 12/760,085

(22) Filed: Apr. 14, 2010

(51) Int. Cl.
*B01F 7/24* (2006.01)

(52) U.S. Cl. ..... 366/149; 366/310; 165/94

(58) Field of Classification Search ..... 366/149, 366/309, 310; 165/94
See application file for complete search history.

(56) References Cited

U.S. PATENT DOCUMENTS

| | | | | | |
|---|---|---|---|---|---|
| 197,755 | A | * | 12/1877 | Banister | 241/282.1 |
| 1,289,613 | A | * | 12/1918 | Bell | 165/94 |
| 2,638,329 | A | * | 5/1953 | Weygand et al. | 366/311 |
| 3,154,123 | A | * | 10/1964 | Tomlinson | 241/101.6 |
| 5,184,783 | A | * | 2/1993 | Hockmeyer et al. | 241/172 |
| 5,497,948 | A | * | 3/1996 | Hockmeyer | 241/46.17 |
| 5,549,384 | A | | 8/1996 | Reynolds | |
| 7,175,118 | B2 | | 2/2007 | Hockmeyer | |

* cited by examiner

*Primary Examiner* — David L Sorkin
(74) *Attorney, Agent, or Firm* — Arthur Jacob

(57) ABSTRACT

An apparatus and method for mixing feedstock within a vessel wherein the feedstock is moved along a heat transfer surface within the vessel. A mixing blade assembly includes a mixing blade and at least one mixing blade support member moved within the vessel to sweep forward along a path of travel extending adjacent the heat transfer surface. Feedstock is circulated within the vessel by the mixing blade, and the mixing blade support member includes a mixing surface confronting the heat transfer surface. The mixing surface is spaced from the heat transfer surface and is configured such that feedstock material is squeezed between the mixing surface and the heat transfer surface so as to be subjected to mixing shear and heat transfer between the squeezed feedstock material and the heat transfer surface. A scraper blade is located on the mixing blade support member in position to trail behind a trailing face of the mixing blade support member and is engaged with the heat transfer surface during movement of the mixing blade support member along the path of travel so as to scrape feedstock material from the heat transfer surface and direct the squeezed feedstock material to the mixing blade to be mixed with the feedstock circulated within the vessel by the mixing blade.

18 Claims, 7 Drawing Sheets

MIXING BLADE ASSEMBLY WITH TRAILING SCRAPERS AND METHOD

The present invention relates generally to apparatus and method for mixing liquids and, in particular, feedstock in the form of viscous liquids containing solid constituents, and pertains, more specifically, to directing the flow of such a feedstock to and from heat transfer surfaces within a vessel containing the feedstock in order to enhance heat transfer between the feedstock and the vessel, while attaining greater uniformity within a reduced mixing time.

Conventional mixing machines commonly employ mixing blades which confront and move across corresponding surfaces in a vessel within which a feedstock is contained while being mixed so as to facilitate the conduct of heat between the feedstock and these surfaces of the vessel. For example, in a typical mixing apparatus, a mixing blade constructed in the form of a helix is rotated within a vessel having a circular cylindrical side wall extending upwardly from a complementary circular bottom wall, the mixing blade being carried by a support structure having a horizontal support member which sweeps across the bottom wall and a vertical support member which sweeps across the side wall, while the feedstock is circulated within the vessel toward and away from the walls of the vessel by the helical mixing blade. The horizontal and vertical support members carry scrapers which engage corresponding walls of the vessel to scrape feedstock from the walls as the support members sweep past respective walls; however, the support members themselves play little or no part in moving the feedstock toward or away from the walls of the vessel to effect the desired heat transfer during a mixing operation.

The present invention provides a construction in which the support structure that carries the mixing blade works in concert with the mixing blade to attain better heat transfer between the feedstock and the walls of the vessel, with a concomitant increase in uniformity gained throughout the feedstock in less mixing time. As such, the present invention attains several objects and advantages, some of which are summarized as follows: Provides a mixing blade assembly in which a mixing blade support structure includes support members constructed to increase the effectiveness of the mixing blade assembly in mixing a batch of feedstock in a mixing vessel; facilitates heat transfer between a batch of feedstock and the walls of the vessel within which the feedstock is mixed, for attaining increased uniformity throughout the batch in less mixing time; reduces resistance to efficient circulation of feedstock within a batch of feedstock being mixed in a mixing vessel, with a concomitant reduction of energy needed to complete a mixing operation; provides a mixing blade assembly placed within a mixing vessel with an additional mixing mechanism, which mixing blade assembly is constructed to interact with the additional mixing mechanism to assist in circulating feedstock within the batch for increased effectiveness of both the mixing blade assembly and the additional mixing mechanism; attains a more uniform mixture within a batch of feedstock in less time and with the consumption of less energy; simplifies the maintenance of a mixing blade assembly for economical long-term operation; provides a rugged mixing blade assembly capable of exemplary performance over an extended service life.

The above objects and advantages, as well as further objects and advantages, are attained by the present invention which may be described briefly as a mixing apparatus for mixing constituents of a feedstock, the mixing apparatus comprising: a vessel including a heat transfer surface within the vessel for being engaged by the feedstock as the constituents of the feedstock are mixed within the vessel; a mixing blade assembly including a mixing blade and at least one mixing blade support member, the mixing blade assembly being adapted to move within the vessel to sweep the mixing blade and the mixing blade support member in a forward direction along a path of travel extending adjacent the heat transfer surface to circulate feedstock within the vessel; the mixing blade support member having a mixing surface confronting the heat transfer surface and spaced from the heat transfer surface to establish a passage between the mixing surface and the heat transfer surface, the mixing surface being configured to squeeze feedstock material passing through the passage, whereby the feedstock material squeezed within the passage will be subjected to mixing shear and to heat transfer between the squeezed feedstock and the heat transfer surface; and a scraper blade carried by the mixing blade support member in position to trail behind the mixing surface of the mixing blade support member and engage the heat transfer surface upon movement of the mixing blade support member along the path of travel so as to scrape from the heat transfer surface feedstock material squeezed between the mixing surface and the heat transfer surface and direct the squeezed feedstock material toward the mixing blade to be mixed with feedstock circulated by the mixing blade.

In addition, the invention includes a method for mixing feedstock within a vessel wherein the feedstock is moved along a heat transfer surface within the vessel as the feedstock is mixed within the vessel, the method comprising: providing a mixing blade assembly including a mixing blade and at least one mixing blade support member, the mixing blade support member having a mixing surface; confronting the mixing surface with the heat transfer surface and spacing the mixing surface from the heat transfer surface to establish a passage between the mixing surface and the heat transfer surface, the mixing surface being configured to squeeze feedstock material passed through the passage; moving the mixing blade assembly within the vessel to sweep the mixing blade and the mixing blade support member in a forward direction along a path of travel extending adjacent the heat transfer surface to circulate feedstock within the vessel and pass feedstock material through the passage to squeeze the feedstock material between the mixing surface and the heat transfer surface; placing a scraper blade on the mixing blade support member in position to trail behind the mixing surface of the mixing blade support member; and engaging the scraper blade with the heat transfer surface during movement of the mixing blade support member along the path of travel so as to scrape from the heat transfer surface feedstock material squeezed within the passage and direct the squeezed feedstock material toward the mixing blade, whereby feedstock material squeezed within the passage is subjected to mixing shear and heat transfer between the squeezed feedstock material and the heat transfer surface and then mixed with feedstock circulated by the mixing blade.

The invention will be understood more fully, while still further objects and advantages will become apparent, in the following detailed description of preferred embodiments of the invention illustrated in the accompanying drawing, in which.

Figure 1:
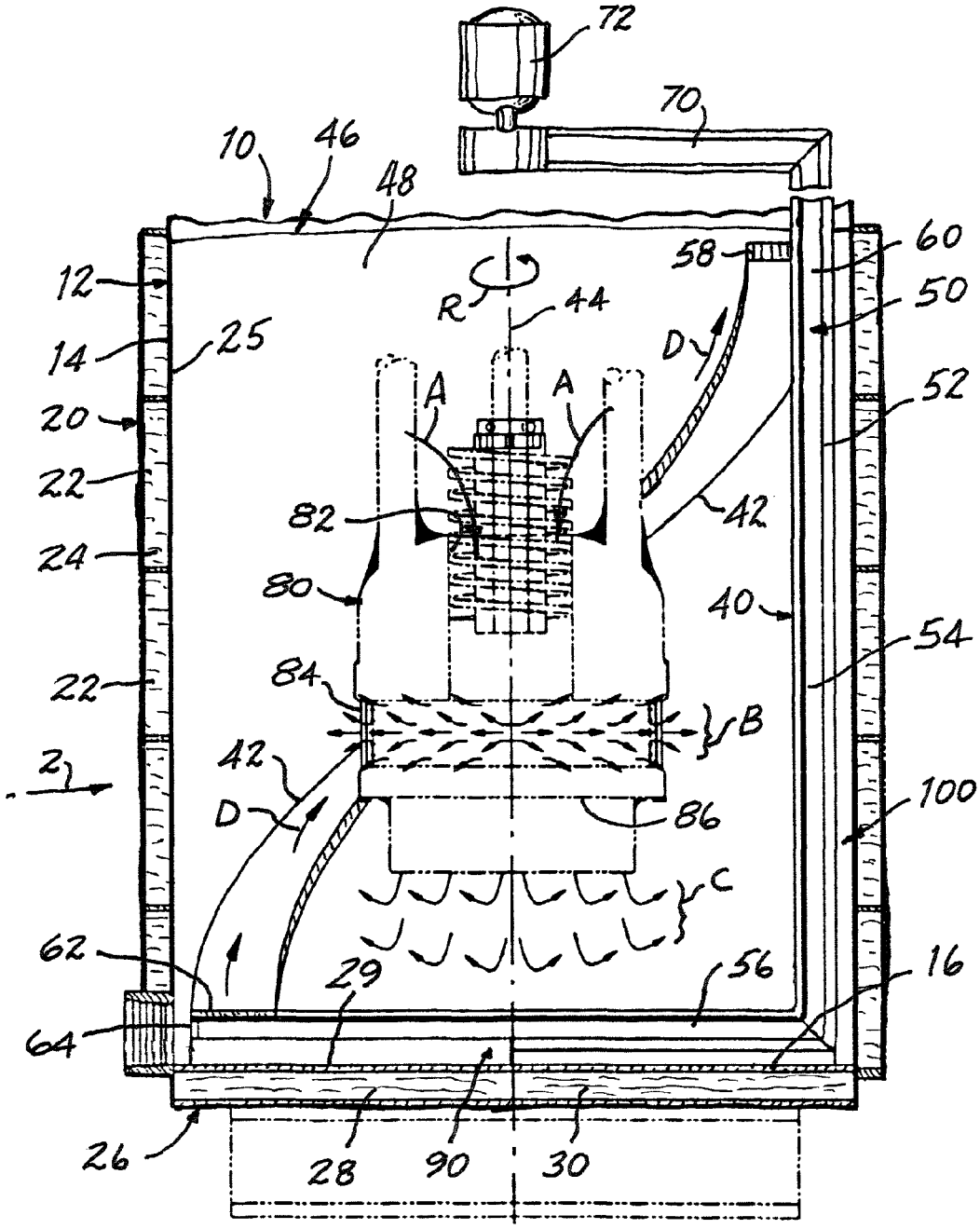
FIG. 1 PRIOR ART
FIG. 1 is a somewhat diagrammatic, vertical cross-sectional view of a mixing apparatus constructed in accordance with the prior art.
Figure 2:
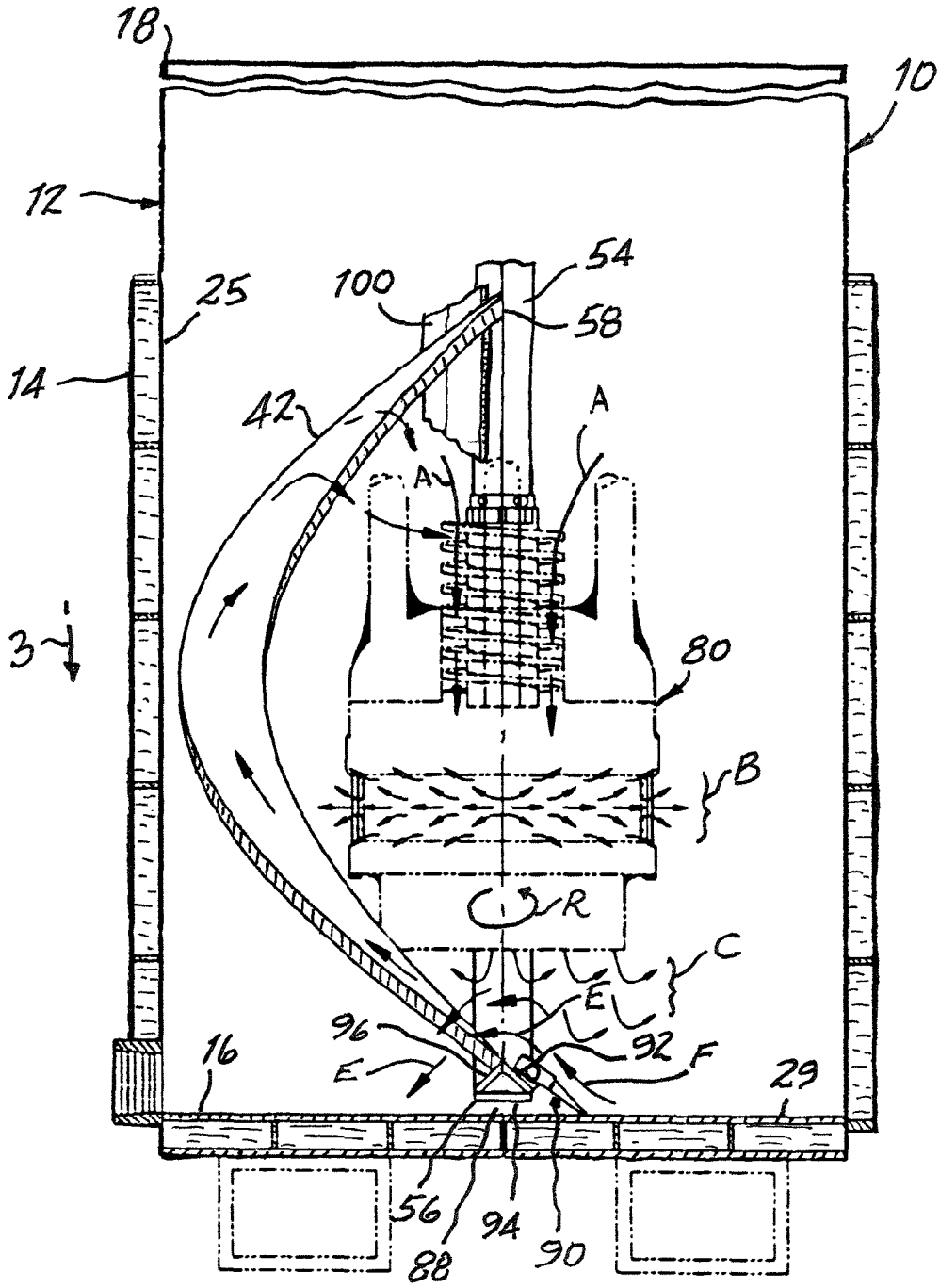
FIG. 2 PRIOR ART
FIG. 2 is a somewhat diagrammatic, vertical cross-sectional view of the apparatus, taken in the direction of arrow 2 in FIG. 1.
Figure 3:
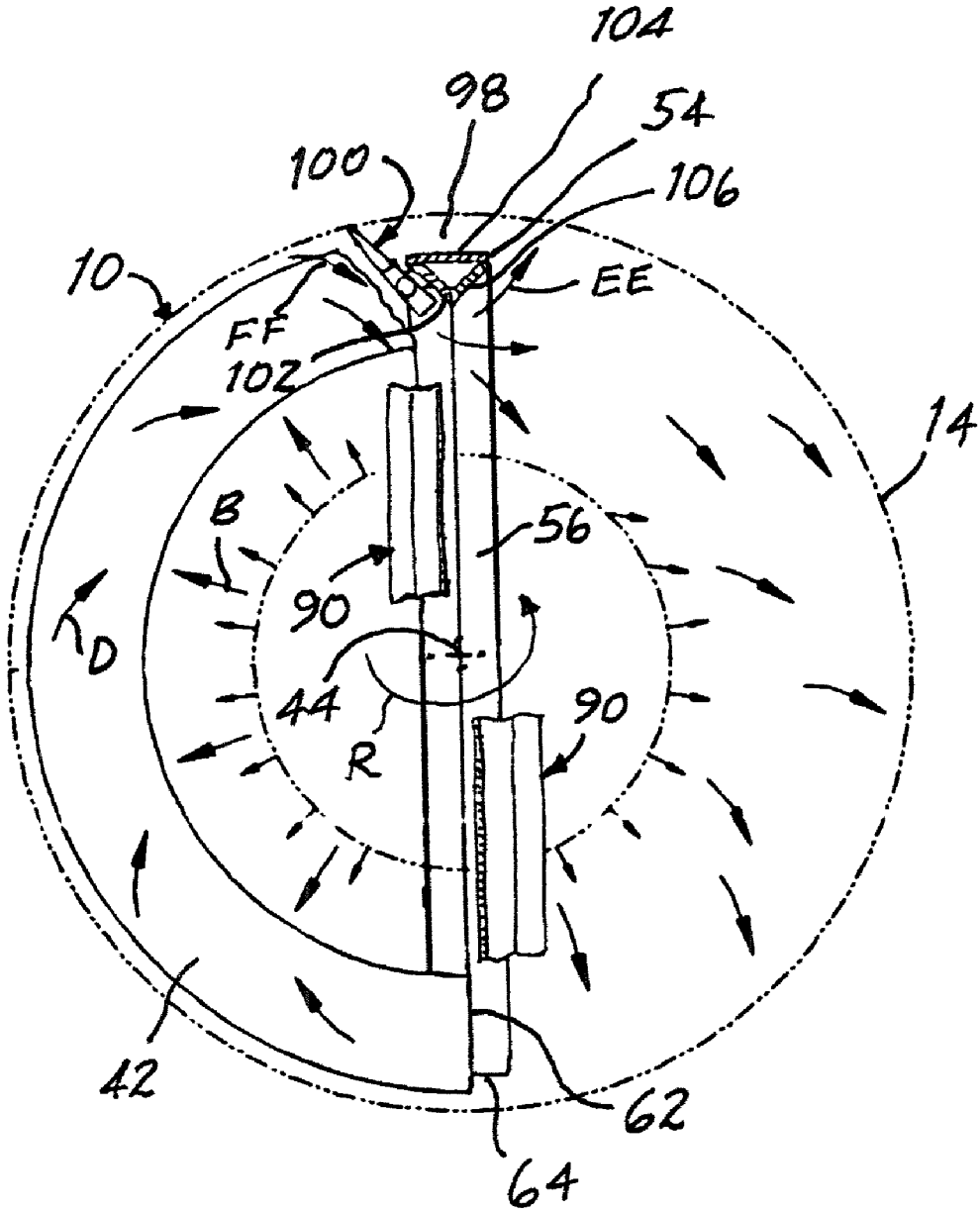
FIG. 3 PRIOR ART
FIG. 3 is a somewhat diagrammatic, horizontal cross-sectional view of the apparatus, taken in the direction of arrow 3 in FIG. 2.

Referring now to the drawing, and especially to FIGS. 1 through 3 thereof, a mixing apparatus constructed in accordance with the prior art is shown at 10 and is seen to include a vessel 12 having a circular cylindrical vertical side wall 14 extending upwardly from a circular horizontal bottom wall 16 to a top end 18. A cylindrical jacket 20 surrounds the side wall 14 and includes vertically arranged chambers 22 for circulating a heat transfer fluid 24 in juxtaposition with vertical side wall 14 and heat transfer surface 25 provided by side wall 14. A circular jacket 26 is juxtaposed with bottom wall 16 and includes horizontally arranged chambers 28 for circulating a heat transfer fluid 30 in juxtaposition with bottom wall 16 and heat transfer surface 29 provided by bottom wall 16.

A mixing blade assembly 40 includes a helical mixing blade 42 and is mounted for rotation within vessel 12, about a central axis of rotation 44, to rotate mixing blade 42 in a direction R about the central axis of rotation 44 and effect mixing of a batch 46 of feedstock 48 placed within vessel 12. Mixing blade 42 is juxtaposed with vertical side wall 14 and, upon rotation about axis of rotation 44, in the direction R, effects mixing of the feedstock 48 while driving the feedstock 48 generally upwardly, in a direction from the bottom wall 16 toward the top end 18 of the side wall 14 to circulate the feedstock 48 within the vessel 12.

Mixing blade 42 is carried by a support structure 50 of the mixing blade assembly 40, the support structure 50 including a generally L-shaped frame 52 comprised of a vertical support member 54 and a horizontal support member 56. The mixing blade 42 is affixed, adjacent upper end 58 of the mixing blade 42, to the frame 52, adjacent upper portion 60 of vertical support member 54, and is affixed, adjacent lower end 62 of the mixing blade 42, to the frame 52, adjacent end 64 of horizontal support member 56, as by welding the mixing blade 42 to the frame 52 at each end 58 and 62 of mixing blade 42. The frame 52 is affixed, adjacent upper portion 60 of vertical support member 54, to a drive member 70 which, in turn, is coupled to a drive motor 72 for effecting rotation of the frame 52. An additional mixing mechanism is placed within vessel 12, and is shown in the form of a submersible media mill 80 located coaxial with mixing blade assembly 40 and mixing blade 42, the media mill 80 having an inlet at 82 and outlets at an apertured wall 84 and at an apertured bottom 86, as is known in media mills.

In the operation of mixing apparatus 10, mixing blade assembly 40 is rotated simultaneously with the operation of media mill 80, and feedstock 48 is circulated within vessel 12. Thus, feedstock 48 enters media mill 80 at inlet 82, as indicated by arrows A, is processed by the media mill 80 and exits through apertured wall 84 and bottom 86, directed generally toward the side wall 14, as indicated by arrows B, and toward the bottom wall 16 of the vessel 12, as indicated by arrows C. Helical mixing blade 42 moves the feedstock 48 upwardly, as indicated by arrows D, to once again enter the media mill 80 at inlet 82, again as indicated by arrows A.

Usually, feedstock 48 consists of a viscous liquid which contains solid constituents and tends to accumulate along the side wall 14 and the bottom wall 16 of vessel 12, at the respective heat transfer surfaces 25 and 29. In order to facilitate the transfer of heat between the feedstock 48 and the heat transfer surfaces 25 and 29 of walls 14 and 16 of vessel 12, mixing blade assembly 40 is provided with scrapers which engage the walls 14 and 16, as the mixing blade assembly 40 is rotated, to scrape accumulated feedstock from the heat transfer surfaces 25 and 29 of the walls 14 and 16 and maintain contact between the circulating feedstock 48 and the heat transfer surfaces 25 and 29 of the walls 14 and 16. Thus, as seen somewhat diagrammatically in FIGS. 2 and 4, horizontal support member 56 is spaced from bottom wall 16 by a space 88 and has a triangular cross-sectional configuration, and a bottom scraper blade 90 is carried by the horizontal support member 56, mounted to a leading face 92 of the support member 56, angled to engage the bottom wall 16 and scrape feedstock from the heat transfer surface 29 of the bottom wall 16, and into circulation, as indicated by arrow F. The triangular cross-sectional configuration is oriented with a bottom face 94 of the support member 56 confronting the bottom wall 16, substantially parallel to the bottom wall 16, and following behind the scraper blade 90, while a trailing face 96 of the support member 56 follows behind the leading face 92 and the scraper blade 90. Scraped feedstock material S is a portion of feedstock 48 intercepted by scraper blade 90 ahead of support member 56 and is directed by scraper blade 90 to flow generally upwardly, away from bottom wall 16, and over support member 56, as indicated by arrows E. Thus, little or no feedstock flows through the space 88 between the support member 56 and bottom wall 16.

Figure 5:
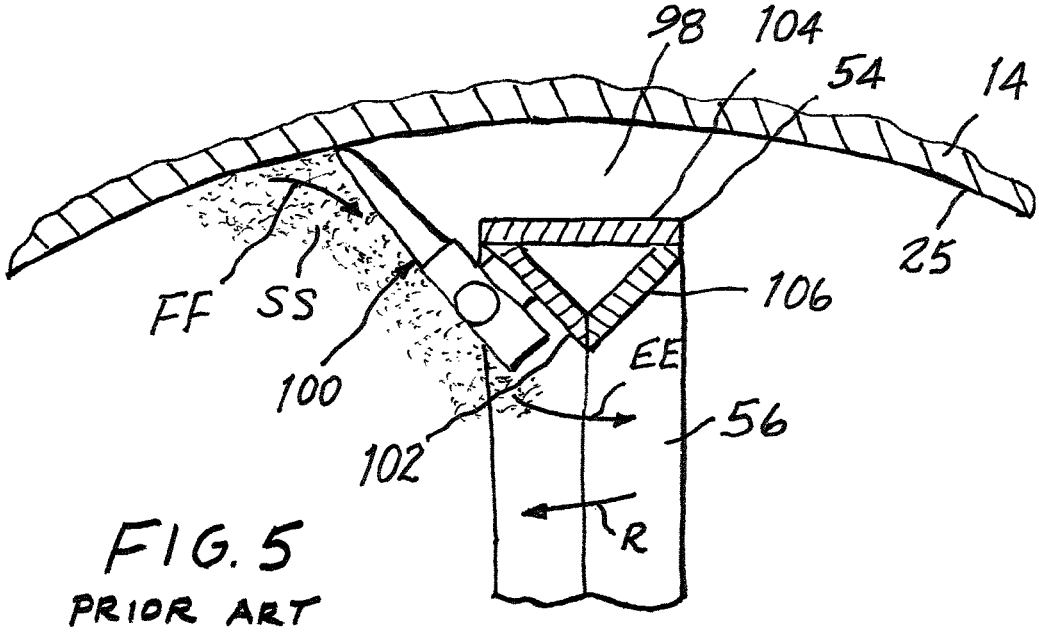
FIG. 5 PRIOR ART
FIG. 5 is an enlarged fragmentary cross-sectional view of a portion of FIG. 3.

In a like manner, as seen somewhat diagrammatically in FIGS. 3 and 5, vertical support member 54 has a triangular cross-sectional configuration spaced from side wall 14 by a space 98. A side scraper blade 100 is carried by the vertical support member 54, mounted to leading face 102 of the support member 54, angled to engage the heat transfer surface 25 of the side wall 14 and scrape feedstock from the heat transfer surface 25 of side wall 14, and into circulation, as indicated by arrow FF. The triangular cross-sectional configuration of the support member 54 is oriented so that a side face 104 of the support member 54 confronts the side wall 14, is substantially parallel to the side wall 14, and follows behind the scraper blade 100, while a trailing face 106 of the support member 54 follows behind the leading face 102 and the scraper blade 100. Scraped feedstock SS is that portion of feedstock 48 intercepted ahead of support member 54 and is directed by scraper blade 100 to flow generally sideways, away from side wall 14, and over support member 54, as indicated by arrows EE. Thus, little or no feedstock 48 flows through the space 98 between the support member 54 and side wall 14.

Turning now to FIGS. 6 through 9, as well as with some reference to FIGS. 1 through 5, a mixing apparatus constructed in accordance with the present invention is shown at 110 and, as before, is seen to include a vessel 112 having a circular cylindrical vertical side wall 114 extending upwardly from a complementary end wall, shown in the form of a circular horizontal bottom wall 116, to a top end 118. A cylindrical jacket 120 surrounds the side wall 114 and includes vertically arranged chambers 122 for circulating a heat transfer fluid 124 in juxtaposition with side wall 114 and heat transfer surface 125 provided by side wall 114. A circular jacket 126 is juxtaposed with bottom wall 116 and includes horizontally arranged chambers 128 for circulating a heat transfer fluid 130 in juxtaposition with bottom wall 116 and heat transfer surface 129 provided by bottom wall 116.

A mixing blade assembly 140 includes a helical mixing blade 142 and is mounted for rotation within vessel 112, about a central axis of rotation 144, to rotate mixing blade 142 in a direction RR about the central axis of rotation 144 and effect mixing of a batch 146 of feedstock 148 placed within vessel 12. Mixing blade 142 is juxtaposed with side wall 114 and, upon rotation about axis of rotation 144, in the direction RR, effects mixing of the feedstock 148 while driving the feedstock 148 generally upwardly, in a direction from the bottom wall 116 toward the top end 118 of the side wall 114, to circulate the feedstock 148 within the vessel 112.

Mixing blade 142 is carried by a support structure 150 of the mixing blade assembly 140, the support structure 150 including a generally L-shaped frame 152 comprised of a vertical support member 154 and a horizontal support member 156. The mixing blade 142 is affixed, adjacent upper end 158 of the mixing blade 142, to the frame 152, adjacent upper portion 160 of vertical support member 154, and is affixed, adjacent lower end 162 of the mixing blade 142, to the frame 152, adjacent end 164 of horizontal support member 156, as by welding the mixing blade 142 to the frame 152 at each end 158 and 162 of mixing blade 142. The frame 152 is rotated about axis of rotation 144 in a manner similar to that described above in connection with the rotation of frame 52 of mixing blade assembly 40. As before, an additional mixing mechanism is placed within vessel 112, and is shown in the form of a submersible media mill 180 located coaxial with mixing blade assembly 140 and mixing blade 142, the media mill 180 having an inlet at 182 and outlets at an apertured wall 184 and at an apertured bottom 186, as is known in media mills.

In the operation of mixing apparatus 110, mixing blade assembly 140 is rotated simultaneously with the operation of media mill 180, and feedstock 148 is circulated within vessel 112. Thus, feedstock 148 enters media mill 180 at inlet 182, as indicated by arrows AA, is processed by the media mill 180, and exits through apertured wall 184, directed generally toward the side wall 114, as indicated by arrows BB, and exits through bottom 186, directed toward the bottom wall 116 of the vessel 112, as indicated by arrows CC. Helical mixing blade 142 moves the feedstock 148 generally upwardly, as indicated by arrows DD, to once again enter the media mill 180 at inlet 182, again as indicated by arrows AA.

As set forth above, usually feedstock 148 consists of a viscous liquid which contains solid constituents and tends to accumulate along the side wall 114 and the bottom wall 116 of vessel 112. As before, in order to assist in the transfer of heat between the feedstock 148 and the respective heat transfer surfaces 125 and 129 of walls 114 and 116 of vessel 112, mixing blade assembly 140 is provided with scrapers which engage the heat transfer surfaces 125 and 129 of walls 114 and 116, as the mixing blade assembly 140 is rotated, to scrape accumulated feedstock from the walls 114 and 116 and maintain contact between the circulating feedstock 148 and the heat transfer surfaces 125 and 129 of walls 114 and 116. Thus, as seen somewhat diagrammatically in FIGS. 6 and 8, horizontal support member 156 has a polygonal cross-sectional configuration, shown in the form of a triangular cross-sectional configuration, and a bottom scraper blade 190 is carried by the horizontal support member 156. However, in the improvement of the present invention, support member 156 includes a mixing surface 191 confronting the bottom wall 116 and spaced from heat transfer surface 129, and mixing surface 191 is configured to squeeze feedstock between mixing surface 191 and heat transfer surface 129 as support member 156 is moved forward, in the direction RR, during rotation of frame 152 about axis of rotation 144. To that end, the triangular cross-sectional configuration of support member 156 is oriented with an apex 5 of the triangular cross-sectional configuration confronting the bottom wall 116 so that support member 156 presents a leading face 192 which makes an angle $\alpha$ with the bottom wall 116, and a trailing face 194 which makes an angle $\beta$ with the bottom wall 116. A passage 188 is established between horizontal support member 156 and bottom wall 116.

Scraper blade 190 is mounted upon a bracket 196 carried by horizontal support member 156, the bracket 196 extending rearwardly to space the scraper blade 190 from trailing face 194 in a rearward direction, relative to the direction of rotation RR of the mixing blade assembly 140. With scraper blade 190 engaged with the heat transfer surface 129 of the bottom wall 116 at an angle $\theta$, and apex $\delta$ of the horizontal support member 156 spaced a short distance from the bottom wall 116, feedstock material M adjacent bottom wall 116 passes through an entrance portion 197 of passage 188 where the passage 188 contracts along leading face 192 and, by virtue of angle $\alpha$, is urged into a narrow constriction, shown in the form of a throat T at an intermediate portion of passage 188 where the feedstock material M is squeezed between the apex $\delta$ and the bottom wall 116, forcing the feedstock material M against the bottom wall 116, thereby generating additional shear within the feedstock material M.

As the feedstock material M passes through throat T and then through an exit portion 198 of passage 188 where the passage 188 expands along the trailing face 194, a pressure drop occurs within the feedstock material M, by virtue of angle $\beta$. Thus, the leading face 192 and the trailing face 194 establish portions 197 and 198 of passage 188 which, in combination with the intermediate portion of passage 188 at narrow throat T, act in concert to create additional shear in feedstock material M for enhanced mixing. At the same time, the trailing scraper blade 190, spaced rearwardly from trailing face 194, directs the flow of feedstock material M toward the helical mixing blade 142, allowing the mixing blade 142 to pick up the feedstock material M and move mixed feedstock 148 toward the top end 118 of side wall 114, enabling the scraped feedstock material M to be moved in an orderly and predictable manner, rendering the mixed feedstock 148 more uniform and enhancing heat transfer between the feedstock 148 and the heat transfer surface 129 provided by bottom wall 116.

Figure 4:
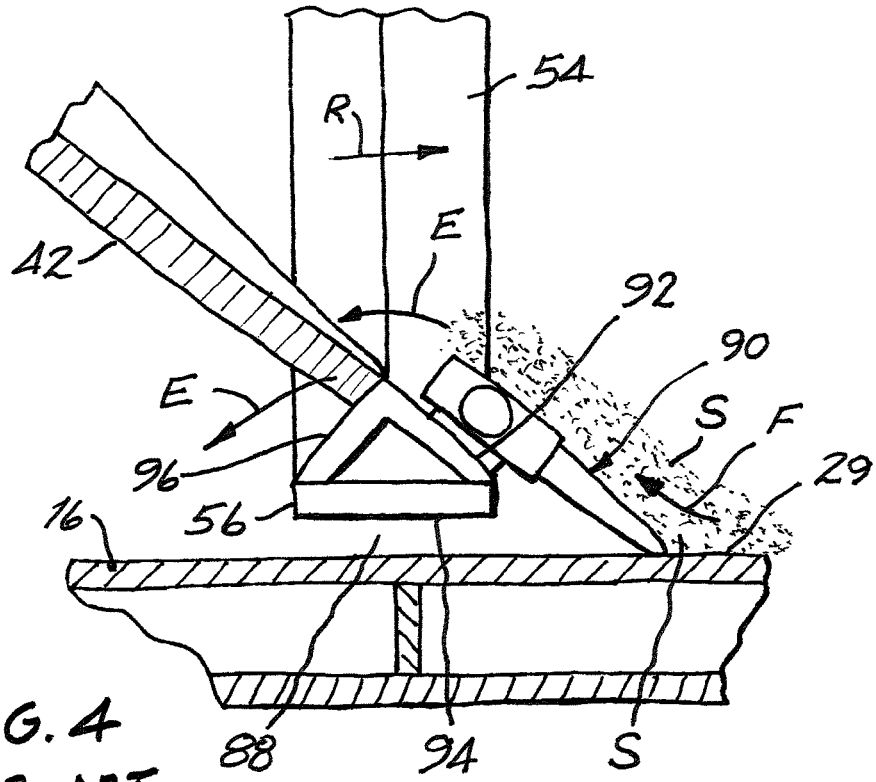
FIG. 4 PRIOR ART
FIG. 4 is an enlarged fragmentary cross-sectional view of a portion of FIG. 2.
Figure 6:
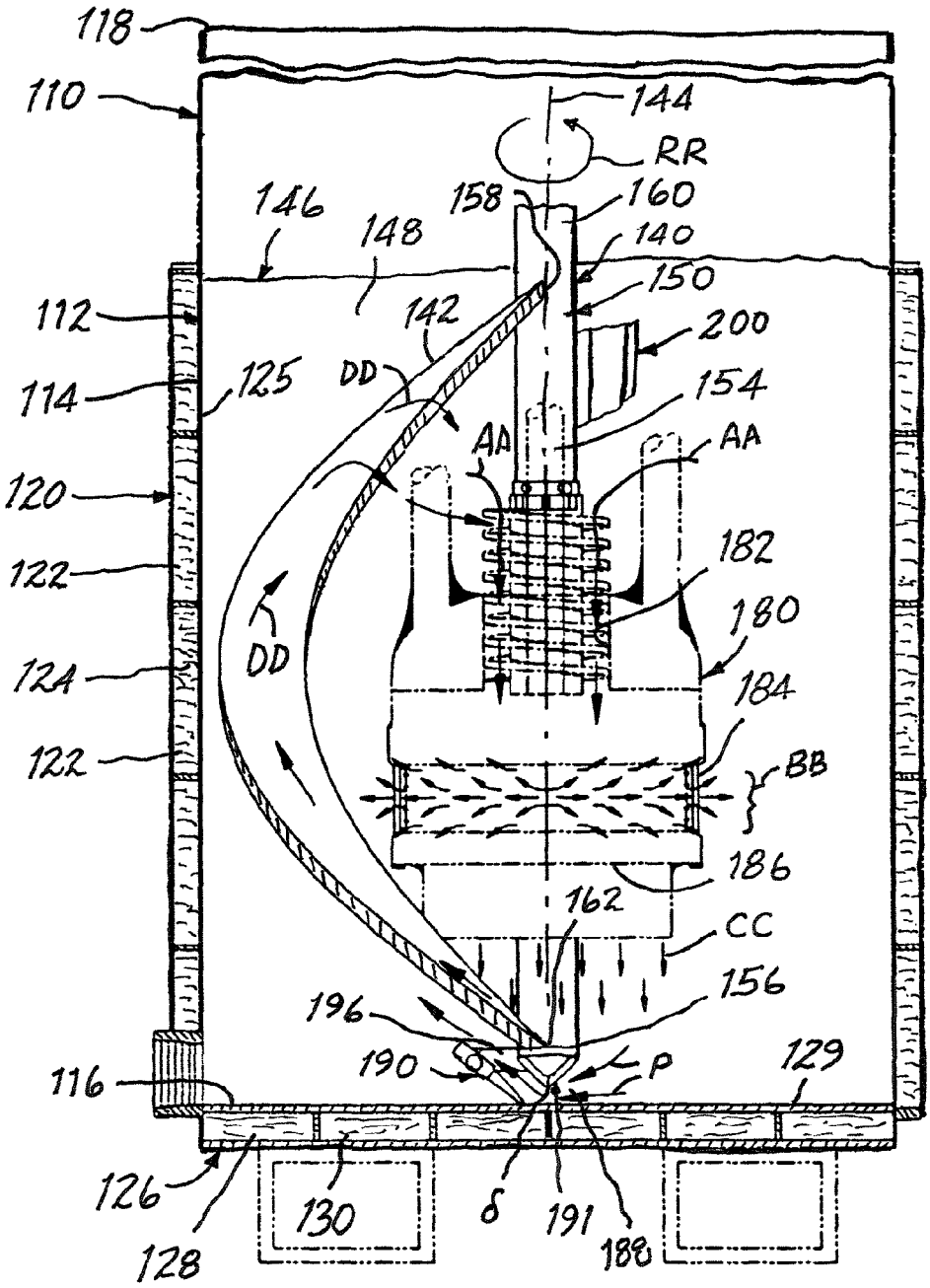
FIG. 6 is a somewhat diagrammatic, vertical cross-sectional view of a mixing apparatus constructed in accordance with the present invention.

Further, whereas the flow pattern followed in mixing apparatus 10, wherein the direction of flow of scraped feedstock material S, as indicated by arrow F in FIGS. 2 and 4, is counter to the direction of flow of feedstock 48 leaving the media mill 80 through the bottom 86 of the media mill 80, as indicated by arrows C, and causes a disruption in the smooth circulation of feedstock 48 from the media mill 80 to the mixing blade 42, the flow of scraped feedstock material M along the path of travel indicated by arrows P in mixing apparatus 110, as illustrated in FIG. 6, is not counter to the flow of feedstock 148 out of the bottom 186 of the media mill 180, in the direction indicated by arrows CC, thereby facilitating a smooth and uninterrupted circulation of feedstock 148 from the media mill 180 to the mixing blade 142, with a concomitant enhancement of uniformity in the mixed batch of feedstock 148 and heat transfer.

Figure 7:
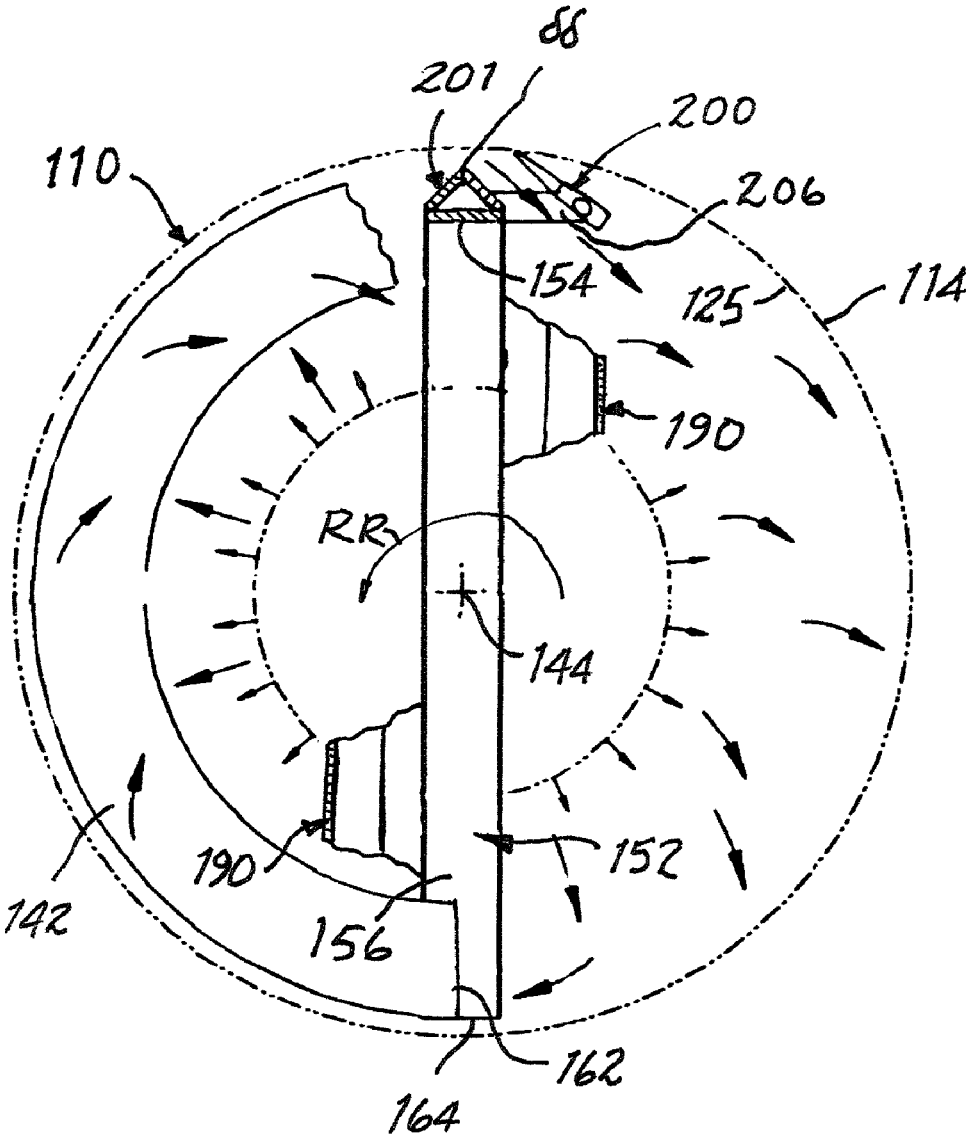
FIG. 7 is a somewhat diagrammatic, horizontal cross-sectional view of the apparatus of FIG. 4, taken in the direction of arrow 7 in FIG. 4.
Figure 8:
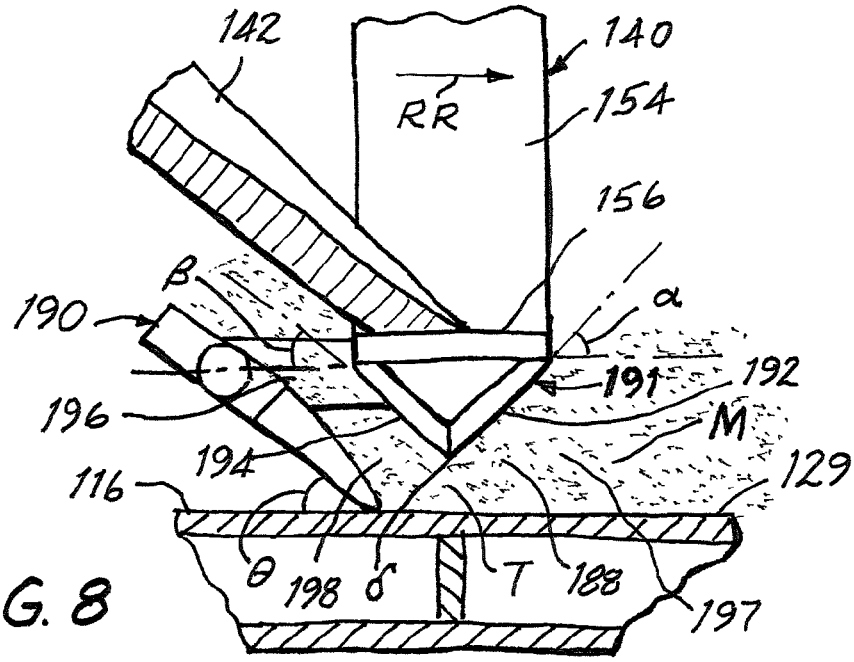
FIG. 8 is an enlarged fragmentary cross-sectional view of a portion of FIG. 6.
Figure 9:
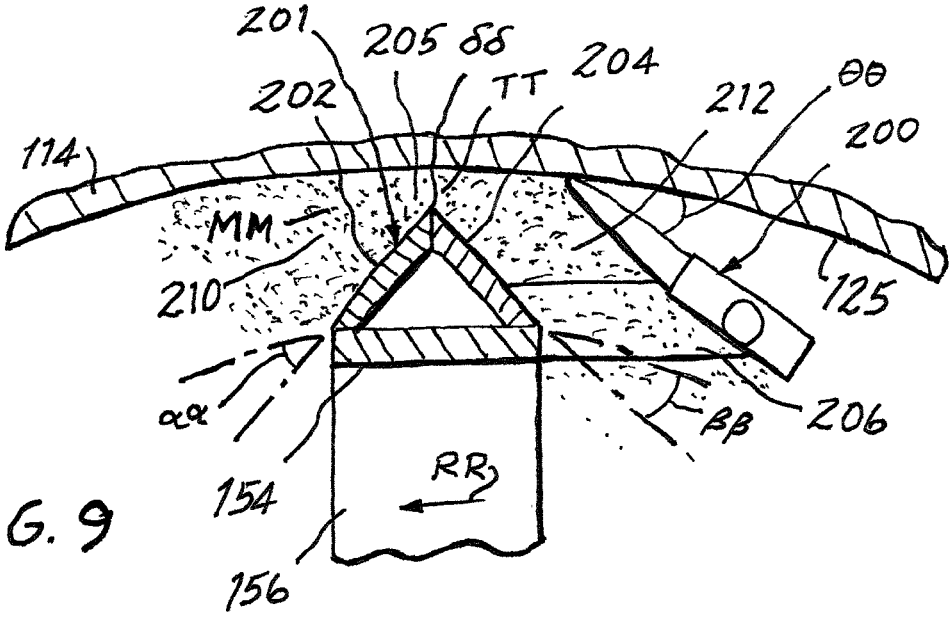
FIG. 9 is an enlarged fragmentary cross-sectional view of a portion of FIG. 7.

In a like manner, as seen somewhat diagrammatically in FIGS. 7 and 9, vertical support member 154 has a polygonal cross-sectional configuration, shown in the form of a triangular cross-sectional configuration, and a side scraper blade 200 is carried by the vertical support member 154. Support member 154 includes a mixing surface 201 confronting the side wall 114 and spaced from heat transfer surface 125. Mixing surface 201 is configured to squeeze feedstock between mixing surface 201 and heat transfer surface 125 as support member 154 moves forward, in the direction RR, during rotation of frame 152 about axis of rotation 144. To that end, the triangular cross-sectional configuration of support member 154 is oriented with an apex δδ of the triangular cross-sectional configuration confronting the side wall 114 so that support member 154 presents a leading face 202 which makes an angle αα with the side wall 114, and a trailing face 204 which makes an angle ββ with the side wall 114. A passage 205 is established between vertical support member 154 and side wall 114.

Scraper blade 200 is mounted upon a bracket 206 carried by vertical support member 154, the bracket 206 extending rearwardly to space the scraper blade 200 from trailing face 204 in a rearward direction, relative to the direction of rotation RR of the mixing blade assembly 140. With scraper blade 200 engaged with heat transfer surface 125 of the side wall 114 at an angle θθ, and apex 66 of the vertical support member 154 spaced a short distance from the side wall 114, feedstock material MM adjacent side wall 114 passes through an entrance portion 210 of passage 205 where the passage 205 contracts along leading face 202 and, by virtue of angle αα, is urged into a narrow constriction, shown in the form of a throat TT at an intermediate portion of passage 205 where the feedstock material MM is squeezed between the apex 66 and the side wall 114, forcing the feedstock material MM against the side wall 114, thereby generating additional shear within the feedstock material MM.

As the feedstock material MM passes out of throat TT and along an exit portion 212 of passage 205, where the passage 205 expands along the trailing face 204, a pressure drop occurs within the feedstock material MM, by virtue of angle ββ. Thus, the leading face 202 and the trailing face 204 establish portions 210 and 212 of passage 205 which, in combination with the intermediate portion of passage 205 at narrow throat TT, act in concert to create additional shear in feedstock material MM for enhanced mixing. At the same time, the trailing scraper blade 200, spaced rearwardly from trailing face 204, directs the feedstock material MM toward the helical mixing blade 142, allowing the mixing blade 142 to pick up the feedstock material MM and move the feedstock material MM toward the top end 118 of side wall 114, enabling the scraped feedstock material MM to be moved in an orderly and predictable manner, rendering the mixed feedstock 148 more uniform and enhancing heat transfer between the feedstock 148 and the heat transfer surface 125 provided by the side wall 114.

Scraper blades 200 and 190 preferably are constructed of a flexible material enabling the scraper blades 200 and 190 to conform closely to the respective side and bottom walls 114 and 116 for effective scraping of feedstock material M and MM to accomplish the objectives of the present invention.

It will be seen that the present invention attains all of the objects and advantages summarized above, namely: Provides a mixing blade assembly in which a mixing blade support structure includes support members constructed to increase the effectiveness of the mixing blade assembly in mixing a batch of feedstock in a mixing vessel; facilitates heat transfer between a batch of feedstock and the walls of the vessel within which the feedstock is mixed, for attaining increased uniformity throughout the batch in less mixing time; reduces resistance to efficient circulation of feedstock within a batch of feedstock being mixed in a mixing vessel, with a concomitant reduction of energy needed to complete a mixing operation; provides a mixing blade assembly placed within a mixing vessel with an additional mixing mechanism, which mixing blade assembly is constructed to interact with the additional mixing mechanism to assist in circulating feedstock within the batch for increased effectiveness of both the mixing blade assembly and the additional mixing mechanism; attains a more uniform mixture within a batch of feedstock in less time and with the consumption of less energy; simplifies the maintenance of a mixing blade assembly for economical long-term operation; provides a rugged mixing blade assembly capable of exemplary performance over an extended service life.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. A mixing apparatus for mixing constituents of a feedstock, the mixing apparatus comprising:

a vessel including a heat transfer surface within the vessel for being engaged by the feedstock as the constituents of the feedstock are mixed within the vessel;

a mixing blade assembly including a mixing blade and at least one mixing blade support member, the mixing blade assembly being adapted to move within the vessel to sweep the mixing blade and the mixing blade support member in a forward direction along a path of travel extending adjacent the heat transfer surface to circulate feedstock within the vessel;

the mixing blade support member having a mixing surface confronting the heat transfer surface and spaced from the heat transfer surface to establish a passage between the mixing surface and the heat transfer surface, the mixing surface being configured to squeeze feedstock material passing through the passage, whereby the feedstock material squeezed within the passage will be subjected to mixing shear and to heat transfer between the squeezed feedstock and the heat transfer surface; and a scraper blade carried by the mixing blade support member in position to trail behind the mixing surface of the mixing blade support member and engage the heat transfer surface upon movement of the mixing blade support member along the path of travel so as to scrape from the heat transfer surface feedstock material squeezed between the mixing surface and the heat transfer surface and direct the squeezed feedstock material toward the mixing blade to be mixed with feedstock circulated by the mixing blade.

2. The mixing apparatus of claim 1 wherein:

the mixing blade support member has a leading face facing in the forward direction, a trailing face located such that the leading face will precede the trailing face as the mixing blade support member is moved forward along the path of travel, and a polygonal cross-sectional configuration including an apex, an adjacent leading side, and an adjacent trialing side; and the mixing blade support member is oriented such that the apex will confront the heat transfer surface upon movement of the mixing blade support member along the path of travel and will be spaced from the heat transfer surface to establish a constriction within an intermediate portion of the passage located between the apex and the heat transfer surface, the leading face extending along the leading side to contract the passage along an entrance portion of the passage leading toward the constriction, the trailing face extending along the trailing side to expand the passage along an exit portion of the passage trailing away from the constriction, whereby the feedstock material passing through the passage in the direction from the entrance portion toward the exit portion will be directed by the scraper blade toward the mixing blade to be mixed with the feedstock circulated by the mixing blade.

3. The mixing apparatus of claim 2 wherein the scraper blade is spaced rearward from the trailing face with respect to the forward direction.

4. The mixing apparatus of claim 3 wherein the polygonal cross-sectional configuration is triangular.

5. The mixing apparatus of claim 1 wherein the vessel includes a vessel wall, and the heat exchange surface extends along the vessel wall.

6. The mixing apparatus of claim 5 wherein:

the vessel wall includes a side wall and an end wall, a side heat transfer surface extending along the side wall, and an end heat transfer surface extending along the end wall;

the mixing blade assembly includes a side mixing blade support member for sweeping along a side path of travel adjacent the side heat transfer surface, and an end mixing blade support member for sweeping along an end path of travel extending adjacent the end heat transfer surface;

each of the side and end mixing support members having a mixing surface confronting a corresponding heat transfer surface and spaced from the corresponding heat transfer surface to establish a corresponding passage between the mixing surface and the corresponding heat transfer surface, each mixing surface being configured to squeeze feedstock material through the passage;

a side scraper blade carried by the side mixing blade support member in position to trail behind the mixing surface of the side mixing blade support member and engage the side heat transfer surface upon movement of the side mixing blade support member along the side path of travel so as to scrape from the side heat transfer surface feedstock material squeezed between the mixing surface and the side heat transfer surface and direct the squeezed feedstock material toward the mixing blade; and an end scraper blade carried by the end mixing blade support member in position to trail behind the mixing surface of the end mixing blade support member and engage the end heat transfer surface upon movement of the end mixing blade support member along the end path of travel so as to scrape from the end heat transfer surface feedstock material squeezed between the corresponding mixing surface and the end heat transfer surface and direct the squeezed feedstock material toward the mixing blade.

7. The mixing apparatus of claim 6 wherein the side wall has a circular cylindrical configuration, and the end wall has a complementary circular configuration.

8. The mixing apparatus of claim 7 wherein:

each of the side and end mixing blade support members has a leading face facing in the forward direction, a trailing face located such that the leading face will precede the trailing face as the mixing blade support member is moved along the path of travel, and a polygonal cross-sectional configuration including an apex, an adjacent leading side, and an adjacent trialing side;

each of the side and end mixing blade support members is oriented such that a corresponding apex will confront a corresponding heat transfer surface upon movement of each mixing blade support member along a corresponding path of travel and will be spaced from the corresponding heat transfer surface to establish a constriction within an intermediate portion of the corresponding passage located between each apex and the corresponding heat transfer surface, each leading face extending along a corresponding leading side and angled to contract the corresponding passage along an entrance portion of the corresponding passage leading toward a corresponding constriction, each trailing face extending along a corresponding trailing side and angled to expand the corresponding passage along an exit portion of the corresponding passage trailing from the corresponding constriction, whereby feedstock material passing through each passage in a direction from a corresponding entrance portion toward a corresponding exit portion will be directed by each scraper blade to the mixing blade to be mixed with the feedstock circulated by the mixing blade.

9. The mixing apparatus of claim 8 wherein each of the side and end scraper blades is spaced rearward from the trailing side of a corresponding mixing blade support member with respect to the forward direction.

10. The mixing apparatus of claim 9 wherein each polygonal cross-sectional configuration is triangular.

11. The mixing apparatus of claim 6 wherein:

each of the side and end mixing blade support members has a leading face facing in the forward direction, a trailing face located such that the leading face will precede the trailing face as the mixing blade support member is moved along the path of travel, and a polygonal cross-sectional configuration including an apex, an adjacent leading side, and an adjacent trialing side;

each of the side and end mixing blade support members is oriented such that a corresponding apex will confront a corresponding heat transfer surface upon movement of each mixing blade support member along a corresponding path of travel and will be spaced from the corresponding heat transfer surface to establish a constriction within an intermediate portion of the corresponding passage located between each apex and the corresponding heat transfer surface, each leading face extending along a corresponding leading side and angled to contract the corresponding passage along an entrance portion of the corresponding passage leading toward a corresponding constriction, each trailing face extending along a corresponding trailing side and angled to expand the corresponding passage along an exit portion of the corresponding passage trailing from the corresponding constriction, whereby feedstock material passing through each passage in a direction from a corresponding entrance portion toward a corresponding exit portion will be directed by each scraper blade to the mixing blade to be mixed with the feedstock circulated by the mixing blade.

12. The mixing apparatus of claim 11 wherein each of the side and end scraper blades is spaced rearward from the trailing side of a corresponding mixing blade support member with respect to the forward direction.

13. The mixing apparatus of claim 12 wherein each polygonal cross-sectional configuration is triangular.

14. The mixing apparatus of claim 13 wherein the side wall has a circular cylindrical configuration, and the end wall has a complementary circular configuration.

15. A method for mixing feedstock within a vessel wherein the feedstock is moved along a heat transfer surface within the vessel as the feedstock is mixed within the vessel, the method comprising:

providing a mixing blade assembly including a mixing blade and at least one mixing blade support member, the mixing blade support member having a mixing surface;

confronting the mixing surface with the heat transfer surface and spacing the mixing surface from the heat transfer surface to establish a passage between the mixing surface and the heat transfer surface, the mixing surface being configured to squeeze feedstock material passed through the passage;

moving the mixing blade assembly within the vessel to sweep the mixing blade and the mixing blade support member in a forward direction along a path of travel extending adjacent the heat transfer surface to circulate feedstock within the vessel and pass feedstock material through the passage to squeeze the feedstock material between the mixing surface and the heat transfer surface;

placing a scraper blade on the mixing blade support member in position to trail behind the mixing surface of the mixing blade support member; and engaging the scraper blade with the heat transfer surface during movement of the mixing blade support member along the path of travel so as to scrape from the heat transfer surface feedstock material squeezed within the passage and direct the squeezed feedstock material toward the mixing blade, whereby feedstock material squeezed within the passage is subjected to mixing shear and heat transfer between the squeezed feedstock material and the heat transfer surface and then mixed with feedstock circulated by the mixing blade.

16. The method of claim 15 wherein the mixing blade support member has a leading face facing in a forward direction, a trailing face located such that the leading face precedes the trailing face as the mixing blade support member is moved forward along the path of travel, and a polygonal cross-sectional configuration including an apex, an adjacent leading side, and an adjacent trialing side, and the method includes:

orienting the mixing blade support member such that the apex confronts the heat transfer surface during movement of the mixing blade support member along the path of travel;

spacing the apex from the heat transfer surface to establish a constriction within an intermediate portion of the passage located between the apex and the heat transfer surface, during movement of the mixing blade support member along the path of travel; and contracting the passage along an entrance portion of the passage located along the leading face extending along the leading side and leading toward the constriction, and expanding the passage along an exit portion of the passage located along the trailing face, extending along the trailing side and trailing away from the constriction.

17. The method of claim 16 including directing the squeezed feedstock material with the scraper blade to conduct the squeezed feedstock material toward the mixing blade.

18. The method of claim 17 including spacing the scraper blade rearward from the trailing side with respect to the forward direction.

* * * * *